US010634423B2

(12) United States Patent
Ayan et al.

(10) Patent No.: US 10,634,423 B2
(45) Date of Patent: Apr. 28, 2020

(54) REFRIGERATOR WITH SABBATH MODE

(71) Applicant: ARCELIK ANONIM SIRKETI, Istanbul (TR)

(72) Inventors: Tuna Ayan, Istanbul (TR); Ferkan Gulbas, Istanbul (TR); Tacettin Ekici, Istanbul (TR); Turgay Ercan, Istanbul (TR); Ilker Takil, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 110 days.

(21) Appl. No.: 15/757,327

(22) PCT Filed: Sep. 4, 2015

(86) PCT No.: PCT/EP2015/070249
§ 371 (c)(1),
(2) Date: Mar. 2, 2018

(87) PCT Pub. No.: WO2017/036555
PCT Pub. Date: Mar. 9, 2017

(65) Prior Publication Data

US 2018/0238614 A1 Aug. 23, 2018

(51) Int. Cl.
*F25D 29/00* (2006.01)
*F25D 21/00* (2006.01)

(52) U.S. Cl.
CPC ..... *F25D 29/00* (2013.01); *F25D 21/006* (2013.01); *F25D 2600/06* (2013.01); *F25D 2700/12* (2013.01)

(58) Field of Classification Search
CPC .... F25D 21/006; F25D 29/00; F25D 2600/02; F25D 2600/06; F25D 2700/02; F25D 2700/12
See application file for complete search history.

(56) References Cited

U.S. PATENT DOCUMENTS 5,808,278 A * 9/1998 Moon ..... A47G 33/00 200/43.01
6,101,825 A * 8/2000 Park ..... F24F 13/12 62/186

(Continued)

FOREIGN PATENT DOCUMENTS

CN 103438660 A 12/2013
WO 2011072515 A1 6/2011

OTHER PUBLICATIONS

International search report and written opinion, dated Apr. 28, 2016, of International Application No. PCT/EP2015/070249; 10 pgs.

*Primary Examiner* — Marc E Norman
(74) *Attorney, Agent, or Firm* — Kilpatrick Townsend & Stockton LLP

(57) ABSTRACT

The present invention relates to a refrigerator comprising a compartment, a door, a refrigeration unit, a temperature sensor for the compartment, an opening/closing sensor for the door and a control unit with a normal mode. The refrigerator of the present invention further comprises an electric power source, a supply circuit which connects the sensors to the electric power source and a switch which allows the user to selectively make/break the power connection to the sensors. The control unit has a Sabbath mode for controlling the refrigeration unit without the sensors and based on a predefined refrigeration/defrost cycle.

18 Claims, 5 Drawing Sheets

(56) References Cited

U.S. PATENT DOCUMENTS

Figure 1:
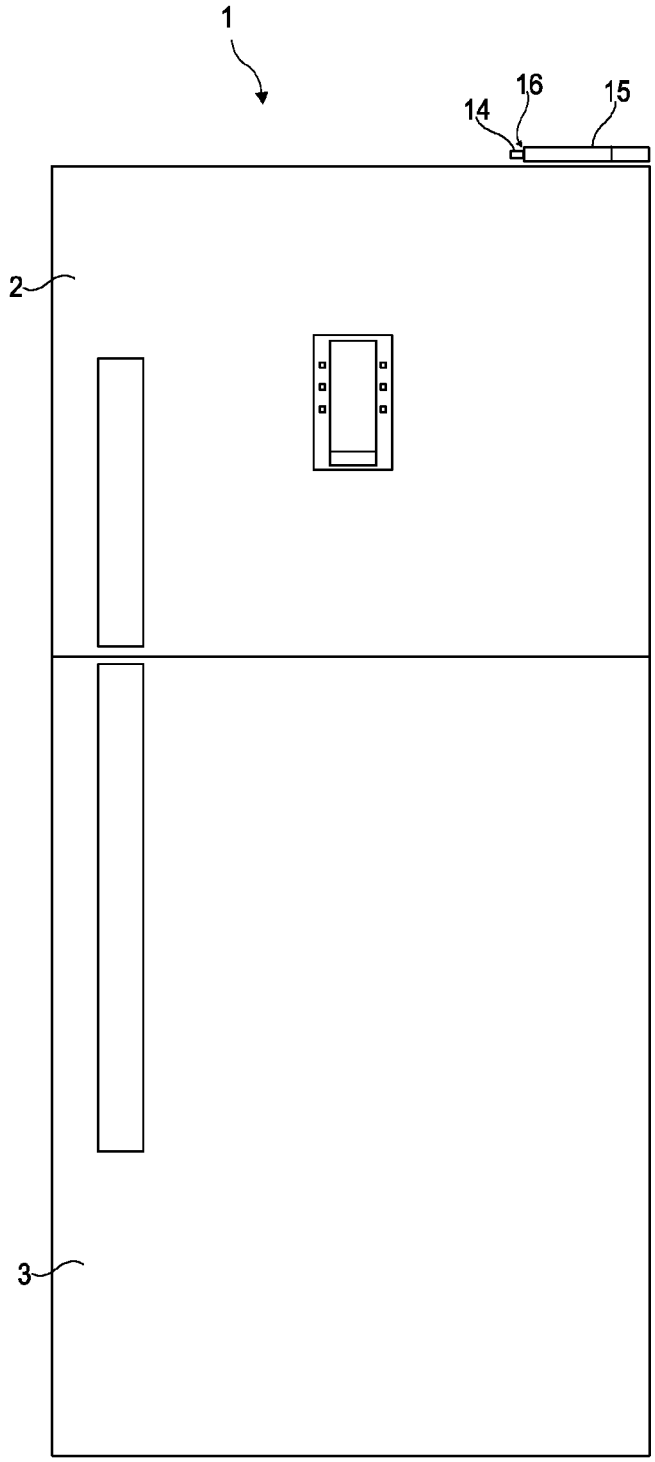

| | | | | |
|---|---|---|---|---|
| 2003/0066827 | A1 | 4/2003 | Daum et al. | |
| 2013/0253725 | A1* | 9/2013 | Ezra | G05B 15/02 700/296 |
| 2014/0025219 | A1* | 1/2014 | Broniak | F24C 7/082 700/296 |
| 2014/0148967 | A1 | 5/2014 | Bayfus | |
| 2014/0166447 | A1* | 6/2014 | Thea | H05B 37/0281 200/19.01 |
| 2014/0327501 | A1* | 11/2014 | Cohen | H01H 3/161 335/39 |
| 2016/0213187 | A1* | 7/2016 | Meusburger | A47G 35/00 |
| 2016/0336123 | A1* | 11/2016 | Johncock | H01H 9/286 |
| 2017/0097187 | A1* | 4/2017 | Thea | F25D 27/005 |
| 2018/0340720 | A1* | 11/2018 | Franks | F25D 29/00 |

* cited by examiner

REFRIGERATOR WITH SABBATH MODE

RELATED APPLICATIONS

This application is a U.S. National Phase of International Application No. PCT/EP2015/070249, filed Sep. 4, 2015, the entire disclosure of which is incorporated by reference herein.

The present invention relates to a refrigerator, in particular to a refrigerator with a Sabbath mode.

Refrigerators are commonly known in the art. A refrigerator generally comprises a freezer compartment and a fresh food compartment each for receiving items to be refrigerated. These compartments are generally refrigerated/defrosted by means of the refrigeration unit respectively to desired target temperatures which can be separately set by the user through the panel-mounted user interface that is built into the door of the fresh food compartment. The refrigerator unit is generally controlled by the control unit based on the the temperatures inside the compartments which are continually sensed by the temperature sensors respectively. In order to improve the refrigeration efficiency, the control unit temporarily halts the refrigeration cycle when the compartments doors are opened, and continues the refrigeration cycle when the compartments doors are closed again. The opening/closing of the doors are generally sensed by the door sensors respectively.

A common problem with the above-described prior art refrigerator is that it does not operate in compliance with Jewish tradition on the weekly Sabbath day.

U.S. Pat. No. 5,808,278 (A) discloses an electrical appliance, in particular an oven which has a Sabbath mode.

An objective of the present invention is to provide a refrigerator which solves the aforementioned problems of the prior art in a cost-effective way and which enables those who observe the Sabbath day to confidently use their refrigerators.

This objective has been achieved by the refrigerator as defined in claim 1 and the control method as defined in claim 9. Further achievements have been attained by the subject-matters respectively defined in the dependent claims.

The refrigerator of the present invention comprises: an electric power source; a supply circuit which connects each sensor to the electric power source and a switch which allows a user to selectively make or break the electric power connection in the supply circuit to the sensors independently from the refrigeration unit and the control unit, wherein the control unit has in addition to the normal mode also a Sabbath mode for controlling the refrigeration unit without the sensors and based on one or more predefined refrigeration cycles and/or one or more predefined defrosts cycles, and wherein the control unit is programmed to detect the selection as to the electric power connection to the sensors, and to execute the normal mode when the connection has been made, and to execute the sabbath mode when the connection has been broken.

A major advantageous effect of the present invention is that the observant Jew can easily and confidently operate his/her refrigerator in a sensorless way on the Sabbath day through activating the switch. Thereby, the refrigerator can be easily modified to comply with the Jewish tradition. Another major advantageous effect of the present invention is that the switch allows the user to physically disconnect the sensors from the electric power source and the other units, and thus the temperature sensors and the doors sensors of the refrigerator need not to be physically removed. Another major advantageous effect of the present invention is that the refrigeration performance can be maintained in the Sabbath mode by way of operating the refrigerator based on the predefined refrigeration cycles and/or the predefined defrosts cycles. Thereby, the items inside the freezer compartment and the fresh food compartment can be effectively refrigerated on the Sabbath day. With the present invention the consumer satisfaction can be increased.

In an embodiment, the Sabbath mode is executed regardless of the user selection when at least one sensor is broken down. This embodiment is particularly advantageous as the items inside the compartments can be effectively refrigerated in the Sabbath mode without the sensors and based on the predefined refrigeration/defrost cycles until the service has been informed and the failure has been removed.

In another embodiment, the predefined refrigeration/defrost cycles are obtained from the information on the latest refrigeration/defrost cycles respectively which is stored into non-volatile storage during the normal mode. This embodiment is particularly advantageous as the items inside the compartments can be more effectively refrigerated in the Sabbath mode by taking into account the currently prevailing environmental conditions which generally depend on the day, the night, and the seasonal temperatures.

In another embodiment, the predefined refrigeration/defrost cycle is obtained from the stored information by averaging the respective ON/OFF intervals of the components in the refrigeration unit, including that of the refrigerant compressor, the evaporator fan, the defrost heater. This embodiment is particularly advantageous as the items inside the compartments can be more uniformly refrigerated in the Sabbath mode.

In another embodiment, the two terminals of the switch are connected via cables to a connector that is detachable to the counterpart connector in the control unit. The counterpart connector is serially joined to the electric power connection leading to the sensors. This embodiment is particularly advantageous as the switch can be easily assembled with the control unit.

In another embodiment, the control unit comprises a printed circuit board. In this embodiment, the non-volatile storage, the electric power source, the supply circuit, and the counterpart connector are disposed onto the printed circuit board. This embodiment is particularly advantageous as the control unit can be easily assembled with the refrigerator.

In another embodiment, the switch is provided as a reed switch that can be activated/deactivated through the associated magnet. This embodiment is particularly advantageous as the user can stow away the magnet away from the reach of children when the refrigerator is in the Sabbath mode. This embodiment is also particularly advantageous as the refrigerator does not change over from the Sabbath mode to the normal mode after unplugging/replugging to the mains power cord when the magnet has been previously released. Thereby, the refrigerator can be easily and safely kept in the Sabbath mode.

In another embodiment, the switch is disposed into the hinge cover of the door and is accessible from the outside by the user. This embodiment is also particularly advantageous as the switch is away from the panel-mounted user interface, and thus the risk of accidentally activating/deactivating the switch has been eliminated or reduced as much as possible.

In another embodiment, the magnet is releasably accommodated in the matching slot of the hinge cover. This embodiment is also particularly advantageous as the magnet can be securely kept in place.

Figure 2:
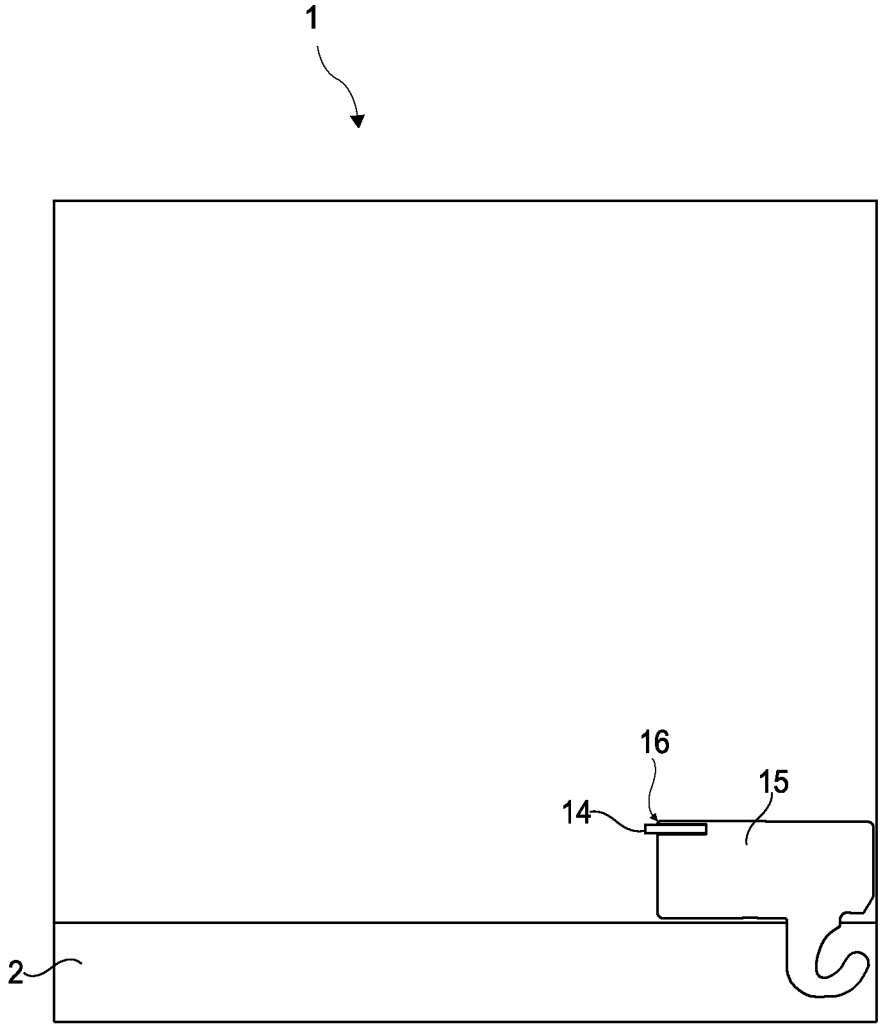
Figure 3:
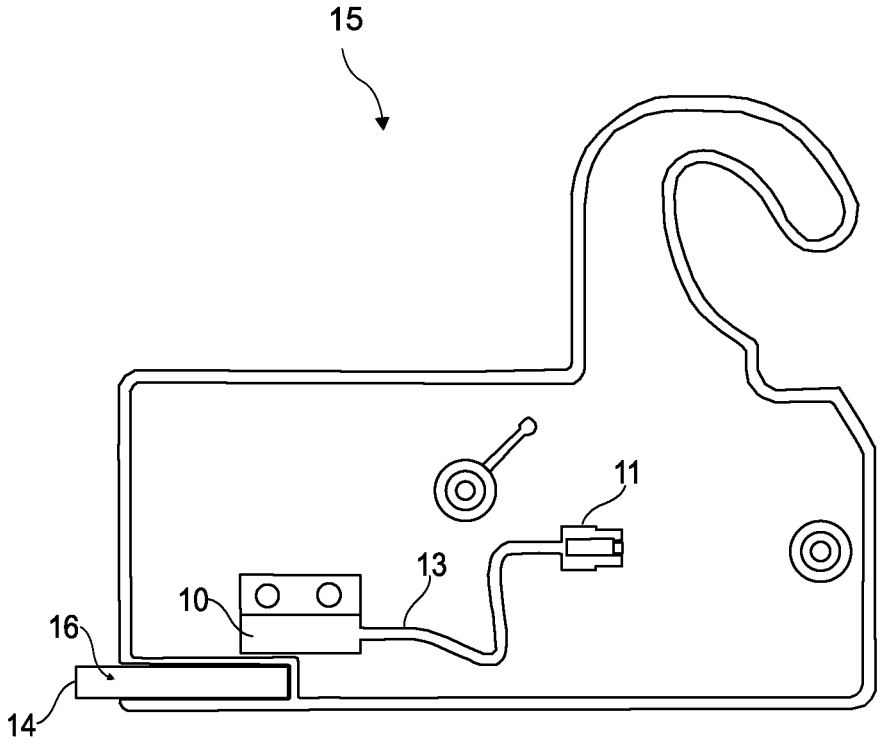
Figure 4:
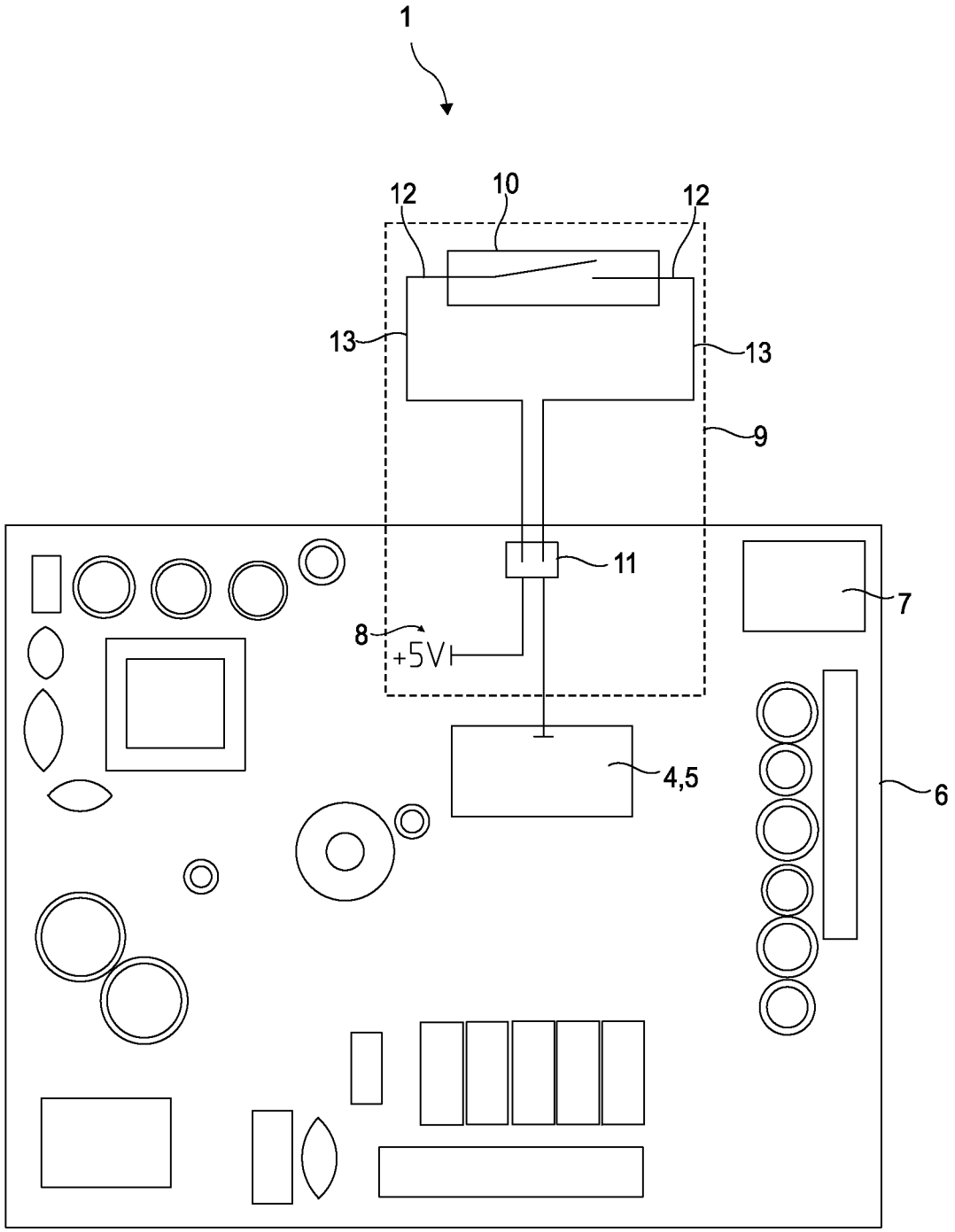
Figure 5:
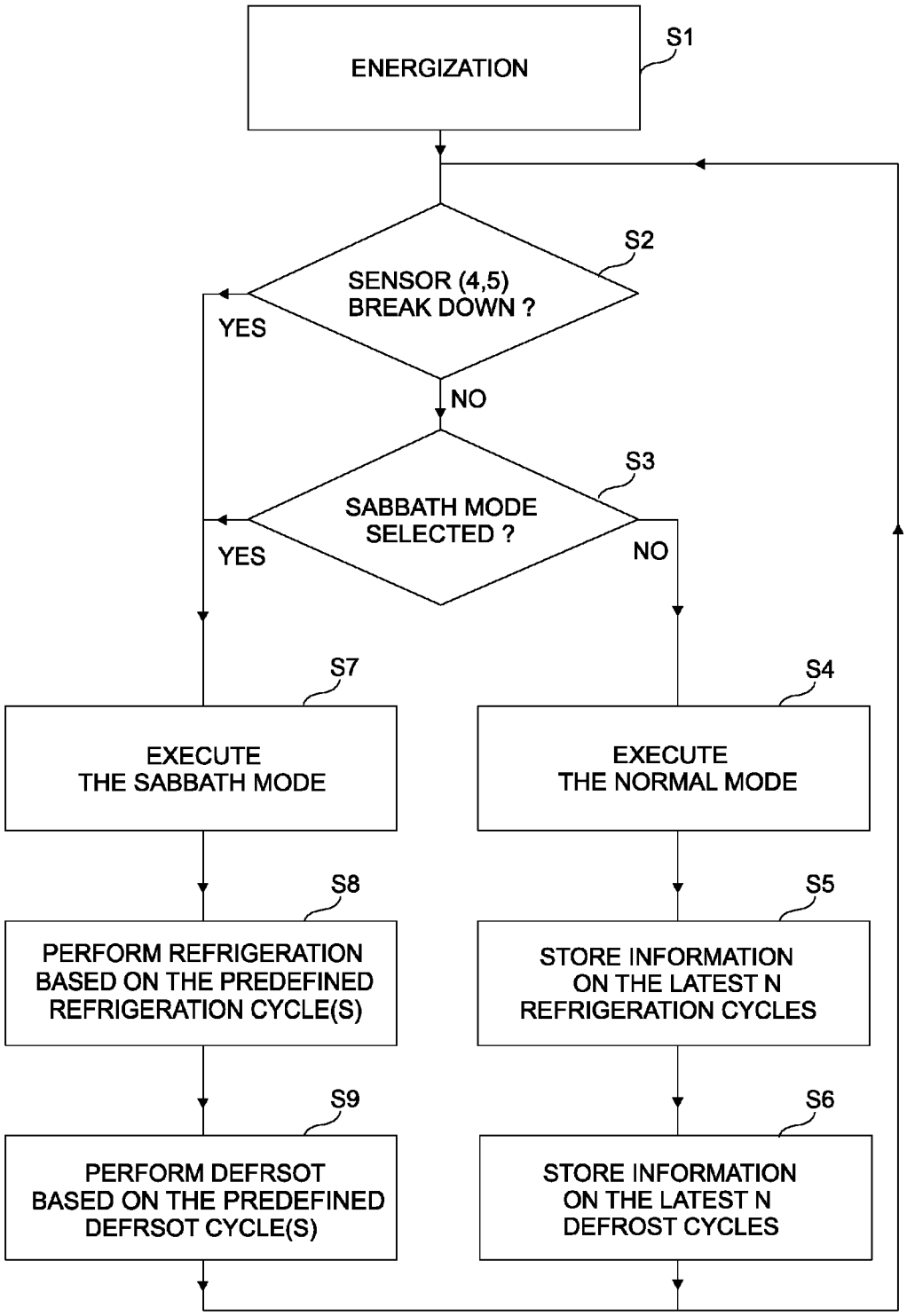

Additional features and additional advantageous effects of the refrigerator of the present invention will become more apparent with the detailed description of the embodiments with reference to the accompanying drawings in which:

FIG. 1—is a schematic front view of a refrigerator according to an embodiment of the present invention;

FIG. 2—is a schematic top view of a refrigerator according to an embodiment of the present invention;

FIG. 3—is a schematic inner view of a hinge cover used in the refrigerator according to an embodiment of the present invention, wherein the hinge cover includes a reed switch and a releasable magnet;

FIG. 4—is another partial schematic view of the refrigerator according to an embodiment of the present invention;

FIG. 5—is a flowchart showing the steps of a method for controlling the refrigerator according to an embodiment of the present invention.

The reference signs appearing on the drawings relate to the following technical features.

1. Refrigerator
2. Door
3. Door
4. Primary sensor
5. Secondary sensor
6. Control unit (Board)
7. Storage
8. Supply circuit
9. Power source
10. Switch (Reed)
11. Connector
12. Terminal
13. Cable
14. Magnet
15. Cover
16. Slot The refrigerator (1) comprises one or more compartments (not shown) for receiving items to be refrigerated; one or more doors (2, 3) for opening/closing the compartments respectively; a refrigeration unit (not shown) for refrigerating/defrosting each compartment; one or more primary sensors (4) for sensing the temperature of the compartments respectively; one or more secondary sensors (5) for sensing the opening/closing of the doors (2, 3) respectively; a control unit (6) for controlling the refrigeration unit, wherein the control unit (6) has a non-volatile storage (7) and a normal mode for controlling the refrigeration unit based on the sensors (4, 5).

The refrigerator (1) of the present invention further comprises: an electric power source (8); a supply circuit (9) which connects each sensor (4, 5) to the electric power source (8) and a switch (10) which allows the user to selectively make or break the electric power connection in the supply circuit (9) to the sensors (4, 5) independently from the refrigeration unit and the control unit (6), wherein the control unit (6) also has Sabbath mode for controlling the refrigeration unit without the sensors (4, 5) and based on one or more predefined refrigeration cycles and/or one or more predefined defrosts cycles, and wherein the control unit (6) is programmed to detect the selection as to the electric power connection, and to execute the normal mode when the connection is made, and to execute the Sabbath mode when the connection is broken.

In an embodiment, the control unit (6) is further programmed to detect whether at least one sensor (4, 5) is broken down. In this embodiment, the control unit (6) is further programmed to execute the Sabbath mode regardless of the selection when at least one sensor (4, 5) is broken down.

In another embodiment, the control unit (6) is further programmed to store, in the normal mode, information on the latest "n" refrigeration cycles into the non-volatile storage (7) as the "n" predefined refrigeration cycles, wherein n is an integer equal to or greater than one. In this embodiment, the information relates to the ON/OFF intervals in each refrigeration cycle of the electrical components (not shown) in the refrigeration unit, including that of the refrigerant compressor (not shown) and the evaporator fan (not shown).

In another embodiment, the control unit (6) is further programmed to store, in the normal mode, information on the latest n defrost cycles into the non-volatile storage (7) as the n predefined defrost cycles, wherein n is an integer equal to or greater than one. In this embodiment, the information relates to the ON/OFF intervals in each defrost cycle of the electrical components in the refrigeration unit, including that of the defrost heater (not shown).

In another embodiment, the control unit (6) is further programmed to determine the average ON/OFF intervals of the latest "n" refrigeration cycle as a predefined refrigeration cycle.

In another embodiment, the control unit (6) is further programmed to determine the average ON/OFF intervals of the latest n defrost cycle as a predefined defrost cycle.

In another embodiment, the refrigerator (1) further comprises: a connector (11). In this embodiment, the terminals (12) of the switch (10) are connected via cables (13) to the connector (11). In this embodiment, the refrigerator (1) further comprises: a counterpart connector (not shown) which is adapted to detachably receive the connector (11). In addition, the counterpart connector is disposed into the control unit (6).

In another embodiment, the control unit (6) comprises a printed circuit board (6). In this embodiment, the non-volatile storage (7), the electric power source (8), the supply circuit (9), and the counterpart connector are disposed onto the printed circuit board (6). Herein, the electric power source (8) is connected to the mains supply (not shown) through a rectifier (not shown).

In another embodiment, the switch (10) is provided as a reed switch (10) which includes a releasable magnet (14). In this embodiment, the reed switch (10) is adapted to break the electric power connection in the supply circuit (9) to the sensors (4, 5) when the magnet (14) is released by the user.

In another embodiment, the refrigerator (1) further comprises: a detachable cover (15) which conceals the hinge of one of the doors (2, 3). In this embodiment, the switch (10) is disposed into the cover (15) and is accessible from the outside by the user.

In another embodiment, the cover (15) has a slot (16) for releasably receiving the magnet (14).

The control method of the present invention comprises: a step (S1) of allowing a user to selectively make or break the electric power connection to the sensors (4, 5) independently from the refrigeration unit and the control unit (6), a first step (S3) of detecting whether the user has made or broken the electric power connection to the sensors (4, 5) and a step (S4-S9) of executing the normal mode when the connection has been made or the Sabbath mode when the connection has been broken, wherein the executing step (S4-S9) includes: a step (S4) of controlling, in the normal mode, the refrigeration unit based on the sensors (4, 5) and a step (S7-S9) of controlling, in the Sabbath mode, the refrigeration unit without the sensors (4, 5) and based on one or more predefined refrigeration cycles and/or one or more predefined defrost cycles.

In another embodiment, the method further comprises: a second step (S2) of detecting whether at least one sensor (4, 5) is broken down, wherein in the executing step (S4-S9) the Sabbath mode is executed regardless of the selection if at least one sensor (4, 5) is broken down.

In another embodiment, the executing step (S4-S9) further includes: a step (S5) of storing, in the normal mode, information on the latest "n" refrigeration cycles as the n predefined refrigeration cycles, wherein n is an integer equal to or greater than one.

In another embodiment, the executing step (S4-S9) further includes: a step (S6) of storing, in the normal mode, information on the latest n defrost cycles as the n predefined defrost cycles, wherein n is an integer equal to or greater than one.

In the subsequent description, the operation of the refrigerator (1) will be described in more detail by way of example. In step (S1), the user energizes the refrigerator (1) by connecting its electric plug (not shown) to the mains supply, and also activates or deactivates the switch (10) so as to select the normal mode or the Sabbath mode. In step (S2), the control unit (6) also detects whether one or more sensors (4, 5) are broken down. If at least one sensor (4, 5) is broken down, then in step (S7) the Sabbath mode is executed. If none of the sensors (4, 5) are broken down, then in step (S3), the control unit (6) detects whether the user has selected the normal mode or the Sabbath mode through the switch (10). In accordance with the selection, the control unit (6) executes in step (S4) the normal mode or in step (S7) the Sabbath mode. In the normal mode, the control unit (6) also stores in steps (S5, S6) information on the latest n refrigeration cycles and the latest n defrost cycles into the non-volatile storage (7). Such information serves as a basis for the preparation of the predefined refrigeration cycles and the predefined defrost cycles to be used in the Sabbath mode.

A major advantageous effect of the present invention is that the observant Jew can easily and confidently operate his/her refrigerator (1) in a sensorless way on the Sabbath day through activating the switch (10). Thereby the refrigerator (1) can be easily modified to comply with the Jewish tradition. Another major advantageous effect of the present invention is that the switch (10) allows the user to physically disconnect the sensors (4, 5) from the electric power source (8) and the control unit (6), and thus the temperature sensors (4) and the doors sensors (5) of the refrigerator need not to be physically removed. Another major advantageous effect of the present invention is that the refrigeration performance can be maintained in the Sabbath mode by way of operating the refrigerator (1) based on the predefined refrigeration cycles and/or the predefined defrosts cycles. Thereby, the items inside the freezer compartment and the fresh food compartment can be effectively refrigerated on the Sabbath day. Other advantageous effects of the present invention can be taken from the above-described embodiments.

The invention claimed is:

1. A refrigerator comprising:

one or more compartments for receiving items to be refrigerated;

one or more doors for opening or closing the compartments respectively;

a refrigeration unit for refrigerating or defrosting each compartment;

one or more primary sensors for sensing the temperature of the compartments respectively;

one or more secondary sensors for sensing the opening or closing of the doors respectively;

a control unit for controlling the refrigeration unit, wherein the control unit has a non-volatile storage and a normal mode for controlling the refrigeration unit based on the sensors;

an electric power source;

a supply circuit which connects each sensor to the electric power source; and a switch which allows the user to selectively make or break the electric power connection in the supply circuit to the sensors independently from the refrigeration unit and the control unit, wherein the control unit also has Sabbath mode for controlling the refrigeration unit without the sensors and based on one or more predefined refrigeration cycles or one or more predefined defrosts cycles, wherein the control unit is programmed to detect the selection and to execute the normal mode when the connection is made and to execute the Sabbath mode when the connection is broken, and wherein the control unit is further programmed to detect whether at least one sensor is broken down, and to execute the Sabbath mode regardless of the selection when at least one sensor is broken down.

2. The refrigerator according to claim 1, wherein the control unit is further programmed to store, in the normal mode, information on the latest "n" refrigeration cycles into the non-volatile storage as the n predefined refrigeration cycles, wherein "n" is an integer equal to or greater than one.

3. The refrigerator according to claim 1, wherein the control unit is further programmed to store, in the normal mode, information on the latest n defrost cycles into the non-volatile storage as the n predefined defrosts cycles, wherein n is an integer equal to or greater than one.

4. The refrigerator according to claim 1, further comprising:

a connector, wherein the terminals of the switch are connected via cables to the connector and a counterpart connector which is adapted to receive the connector, wherein the counterpart connector is disposed into the control unit.

5. The refrigerator according to claim 1, wherein the switch is provided as a reed switch including a releasable magnet wherein the reed switch is adapted to break the electric power connection in the supply circuit to the sensors when the magnet is released by the user.

6. The refrigerator according to claim 5, further comprising:

a cover which conceals a hinge of one of the doors, wherein the switch is disposed into the cover and is accessible from the outside, wherein the cover has a slot for releasably receiving the magnet.

7. The refrigerator according to claim 1, further comprising:

a cover which conceals a hinge of one of the doors, wherein the switch is disposed into the cover and is accessible from the outside.

8. A method of controlling a refrigerator comprising:

a step of allowing a user to selectively make or break the electric power connection to the sensors independently from the refrigeration unit and the control unit;

a first step of detecting whether the user has made or broken the electric power connection to the sensors;

a step of executing the normal mode when the connection is made or the Sabbath mode when the connection is broken; and a second step of detecting whether at least one sensor is broken down, wherein in the executing step the Sabbath mode is executed regardless of the selection if at least one sensor is broken down.

9. The method according to claim 8, wherein the executing step includes:

a step of controlling, in the normal mode, the refrigeration unit based on the sensors and a step of controlling, in the Sabbath mode, the refrigeration unit without the sensors and based on one or more predefined refrigeration cycles or one or more predefined defrost cycles.

10. The method according to claim 8, wherein the executing step includes:

a step of storing, in the normal mode, information on the latest "n" refrigeration cycles as the n predefined refrigeration cycles, wherein n is an integer equal to or greater than one.

11. The method according to claim 8, wherein the executing step includes:

a step of storing, in the normal mode, information on the latest n defrost cycles as the n predefined defrosts cycles, wherein n is an integer equal to or greater than one.

12. A refrigerator comprising:

one or more compartments for receiving items to be refrigerated;

one or more doors for opening or closing the compartments respectively;

a refrigeration unit for refrigerating or defrosting each compartment;

one or more primary sensors for sensing the temperature of the compartments respectively;

one or more secondary sensors for sensing the opening or closing of the doors respectively;

a control unit for controlling the refrigeration unit, wherein the control unit has a non-volatile storage and a normal mode for controlling the refrigeration unit based on the sensors;

an electric power source;

a supply circuit which connects each sensor to the electric power source;

a switch which allows the user to selectively make or break the electric power connection in the supply circuit to the sensors independently from the refrigeration unit and the control unit; and a cover which conceals a hinge of one of the doors, wherein the switch is disposed into the cover and is accessible from the outside, wherein the control unit also has Sabbath mode for controlling the refrigeration unit without the sensors and based on one or more predefined refrigeration cycles or one or more predefined defrosts cycles, and wherein the control unit is programmed to detect the selection and to execute the normal mode when the connection is made and to execute the Sabbath mode when the connection is broken.

13. The refrigerator according to claim 12, wherein the control unit is further programmed to detect whether at least one sensor is broken down, and to execute the Sabbath mode regardless of the selection when at least one sensor is broken down.

14. The refrigerator according to claim 12, wherein the control unit is further programmed to store, in the normal mode, information on the latest "n" refrigeration cycles into the non-volatile storage as the n predefined refrigeration cycles, wherein "n" is an integer equal to or greater than one.

15. The refrigerator according to claim 12, wherein the control unit is further programmed to store, in the normal mode, information on the latest n defrost cycles into the non-volatile storage as the n predefined defrosts cycles, wherein n is an integer equal to or greater than one.

16. The refrigerator according to claim 12, further comprising:

a connector, wherein the terminals of the switch are connected via cables to the connector and a counterpart connector which is adapted to receive the connector, wherein the counterpart connector is disposed into the control unit.

17. The refrigerator according to claim 12, wherein the switch is provided as a reed switch including a releasable magnet wherein the reed switch is adapted to break the electric power connection in the supply circuit to the sensors when the magnet is released by the user.

18. The refrigerator according to claim 12, further comprising:

wherein the cover has a slot for releasably receiving the magnet.

* * * * *